United States Patent [19]

Scholz et al.

[11] Patent Number: 5,065,811

[45] Date of Patent: Nov. 19, 1991

[54] APPARATUS FOR THE MANUFACTURE OF HOT ROLLED STEEL STRIP

[75] Inventors: Heinrich Scholz, Klopstock; Rudolf Guse, Portmannweg, both of Fed. Rep. of Germany

[73] Assignee: SMS Schloemann-Siemag Aktiengesellschaft, Dusseldorf, Fed. Rep. of Germany

[21] Appl. No.: 630,340

[22] Filed: Dec. 17, 1990

Related U.S. Application Data

[63] Continuation of Ser. No. 440,341, Nov. 22, 1989, abandoned.

[30] Foreign Application Priority Data

Nov. 26, 1988 [DE] Fed. Rep. of Germany ..... 3839954

[51] Int. Cl.[5] ..... B22D 11/12; B22D 11/126

[52] U.S. Cl. ..... 164/460; 164/476; 164/477; 164/417; 164/263

[58] Field of Search ..... 164/476, 477, 460, 263, 164/417; 29/527.6, 527.7

[56] References Cited

U.S. PATENT DOCUMENTS 3,153,820 10/1964 Criner ..... 164/468

4,420,029 12/1983 Kameyama et al. ..... 164/417

4,799,535 1/1989 Lemper ..... 164/418

FOREIGN PATENT DOCUMENTS 56-11170 2/1981 Japan ..... 164/263

OTHER PUBLICATIONS

SMS Schloeman Siemag AG Brochure No. W4+9/329, "Compact Strip Production".

*Primary Examiner*—Kuang Y. Lin

*Attorney, Agent, or Firm*—Wolf, Greenfield & Sacks

[57] ABSTRACT

A manufacturing line for making hot rolled steel strip including a mold for the continuous casting of steel strip, a strip guidance device located downstream from the mold for the diversion of the cast strip into a horizontal plane, a crosscutting device, a temperature equalization furnace, and a rolling mill. To reduce capital costs, energy consumption and space requirements, and to avoid metallurgical errors in processing, a curved temperature equalization furnace surrounds the strip guidance device. A straight temperature equalization furnace horizontally adjoins the curved temperature equalization furnace, and includes a means for crosscutting the strip prior to its exit from the temperature equalization environment for subsequent rolling.

28 Claims, 6 Drawing Sheets

APPARATUS FOR THE MANUFACTURE OF HOT ROLLED STEEL STRIP

This application is a continuation of application Ser. No. 07/440,341, filed Nov. 22, 1989, and now abandoned.

BACKGROUND

1. Field of Invention

The invention relates generally to the hot rolling of steel strip. More particularly, the invention relates to apparatus for hot rolling steel strip in direct sequence with a continuous casting strip mold.

2. Summary of the Prior Art

The advantages of hot rolling steel strip in direct sequence with a continuous casting mold are well known in the art. To accomplish this objective, the strip issuing substantially vertically and downwardly from the casting mold must be diverted into a substantially horizontal plane and cut into predetermined lengths. Further, the strip must have a metallurgical structure which is as homogeneous as possible, and a uniform temperature profile along its length, across its width and through its thickness, when it enters the rolling mill. These requirements assure that the expansion of the area of the strip during rolling does not adversely effect the casting operation, and that the final product displays appropriate physical properties for its intended use.

Manufacturing lines for the production of hot rolled steel strip are known in the art. In such lines a mold is provided in which a steel melt is continuously cast such that strip issues from the mold cavity in a substantially vertical downward direction. As the strip leaves the mold, it enters a strip guiding device wherein it is diverted into a substantially horizontal plane by bending, guiding, driving, and straightening rollers. Thereafter, the strip enters a crosscutting device wherein it is cut into lengths for subsequent rolling. The lengths of cut strip then enter a straight temperature equalization furnace from which they are subsequently passed to the rolling mill. The rolling mill may be generally considered to include one or more press rolling devices, a cooling zone, and apparatus for coiling the rolled strip for storage and/or shipment.

One known crosscutting device includes a pair of shearing elements which co-act in a sissors like manner to sever the strip transversely to its direction of travel. It is also known that a pair of press rolls may be located between the outlet of the mold and the inlet of the strip guiding device for the purpose of reducing the thickness of the strip prior to its passage through the remainder of the devices in the manufacturing line. Such initial rolling is advantageous in reducing the forces required to bend and cut the strip thereby reducing the wear upon, and the strength requirements of, the strip guiding device and the crosscutter. The expansion of the area of the strip in such initial rolling has been found to be small enough that casting operations are not seriously adversely effected.

It will be understood that known hot rolled steel strip manufacturing lines represent significant capital investments both in terms of the cost of the necessary equipment, and in terms of the cost of the manufacturing floor space required for the set-up and operation of that equipment. Further, since each of the equipment elements of the manufacturing line is separate from the others, significant thermal energy is lost during the passage of the strip from the mold to the temperature equalization furnace. This lose of thermal energy can lead to metallurgical errors in the final product rendering it either useless or unsuitable for its intended purpose.

SUMMARY OF THE INVENTION

Accordingly, it is an object of the present invention to provide apparatus for the manufacture of hot rolled steel strip which is more compact and less expensive than presently available equipment for the same purpose.

It is also an object of the present invention to provide apparatus for the manufacture of hot rolled steel strip wherein the thermal energy retention by the strip during its passage through the apparatus is improved, thereby avoiding the presence of metallurgical errors in the final product and saving thermal energy.

To accomplish these and other objectives of the invention, the strip guiding and crosscutting functions are performed in a controlled temperature environment. More particularly, the present invention provides a manufacturing line for hot rolled strip including: (1) a mold for the continuous casting of steel strip; (2) a strip guiding means adjacent the outlet of the mold including means for diverting the strip exiting vertically downwardly from the mold into a substantially horizontal plane, and a curved temperature equalization means surrounding the diverting means; (3) a straight temperature equalization means adjoining the downstream end of the strip guiding means including means for transporting the strip through the furnace and means for crosscutting the strip; and (4) a rolling mill located downstream from the outlet end of the straight temperature equalization furnace. This improved apparatus allows the steel strip to be brought from the casting mold to the first pass of the rolling mill in predetermined lengths having substantially homogenious metallurgical structures. Further, since the apparatus of the invention provides the capability of performing the strip diversion and strip crosscutting functions in a temperature equalization environment, rather than under ambient conditions, the manufacturing line may be made shorter and a corresponding capital saving achieved.

Additional features of the invention include in one exemplary embodiment the location of a pair of press rolls between the outlet of the mold and the inlet of the strip guiding means for reducing the thickness of the strip to between about 6–25 mm prior to its passage through the remainder of the apparatus to the rolling mill. The strip guiding means may advantageously be built as a roller hearth furnace. Additionally, the guiding, bending, driving and straightening rollers situated within the furnace for guiding the strip into a horizontal plane may be provided with internal cooling means such as internal channels for the the flow of a cooling fluid. Further, the bearings, drives and control gears of the various rollers may be located outside of the furnace chamber to avoid heat damage. Still further, the strip guiding means may be constructed as a modular unit to facilitate its removal from and/or replacement in the manufacturing line.

In a further embodiment of the invention, the crosscutting means may be a rotating shear mounted upon a bearing support located adjacent one side of the temperature equalization furnace. The bearing support is moveable transversely of the side of the furnace, and supports a pair of vertically spaced shafts carrying cutting edges on their adjacent lateral sides. Adjacent the opposite side of the straight furnace are shaft end supports mounted on a stationary bearing structure. The end supports are connected to drive means by couplings for rotational movement. Opposing doors in the lateral sides of the straight furnace allow the shafts to be extended through the furnace above and below the strip travel path to engage the end supports. Activation of the drive means rotates the end supports causing the cutting edges of the shafts to come together shearing the strip passing therebetween. To facilitate the introduction and removal of the shafts from the furnace, one, or several, of the table rollers carrying the strip through the furnace may be depressed temporarily. It will be understood that this cutting means will be inserted into the furnace chamber only at the point in time at which it is desired to crosscut the strip. In this way wear and heat damage to the cutting means may be avoided while at the same time providing the required crosscutting capability to the apparatus.

Alternatively, the crosscutting means may consist of flame cutting devices adapted for movement into and out of the straight furnace through one or both of the lateral doors. For this purpose, the flame cutter is mounted on the one end of a horizontal guide arm. The other end of the guide arm is attached to a supporting carriage by a swivel bearing such that the horizontal arm may be pivoted about the vertical axis established by the swivel bearing. The carriage itself is moveable transversely to the side of the straight temperature equalization means. To obtain a crosscut normal to the side edges of the strip, the flame cutter is introduced through the lateral door of the furnace and the subsequent movement of the carriage and pivot of the arm are controlled to assure that the cutter travels normally across the moving strip.

BRIEF DESCRIPTION OF THE DRAWINGS

These and other features and advantages of the present invention will occur to those skilled in the art in view of the following detailed description of its preferred embodiments in view of the attached drawings in which.

DETAILED DESCRIPTION OF PREFERRED EMBODIMENTS

Figure 1:
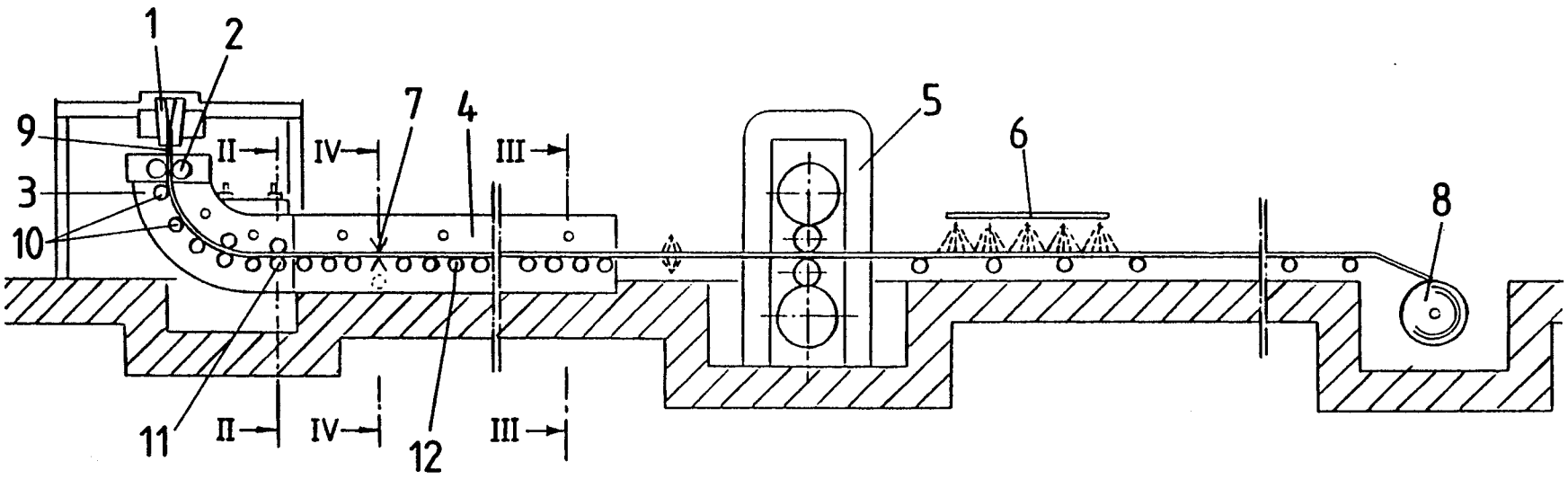
FIG. 1 is a schematic diagram of an apparatus for the manufacture of steel strip in accordance with the present invention.

Referring now to the drawings, and particularly to FIG. 1, there is shown a schematic diagram of a manufacturing line for hot rolled steel strip in accordance with the present invention. The apparatus includes the sequential arrangement of (a) a mold 1 including cooled walls for the continuous casting of steel strip 9, (b) a roll or roller pair 2, (c) a curved temperature equalization furnace 3 surrounding a set of guiding and bending rollers 10 and a pair of pinch rollers 11, (d) a straight, horizontal temperature equalization furnace 4 surrounding a roller table 12 and including a crosscutting device 7, (e) a rolling mill 5, (f) a cooling zone 6, and (q) a coiling device 8. The cooling zone 6 shown in FIG. 1 indicates the use of a fluid cooling medium applied to the strip through spray nozzles after the rolled strip emerges from the rolling mill 5. It will be understood that other cooling means may be employed without departure from the present invention.

As the cast steel strip 9 issues from the mold 1, it first passes through roller pair 2. Roller pair 2 reduces the thickness of the strip to between about 6–25 mm, but does not elongate the strip or retard the passage of the strip from the mold sufficiently to cause adverse effects to the casting operation. By thinning the strip in this manner, it has been found that it is easier to process it through the remaining elements of the manufacturing line. Also, the capital cost of those elements can be reduced because they are subjected to less wear and are not required to exert as much force on the strip during processing. Thereafter, the strip 9 is transferred to the curved temperature equalization furnace 3. Within the furnace 3, the strip 9 is passed over and/or through guiding and bending rolls 10, and straightening and drive rolls 11. The strip exits the rolls 11 substantially horizontally directly into the adjoining straight temperature equalization furnace 4. The furnace 4 is provided with a roller table 12 for the conveyance of the strip 9 therethrough.

Figure 2:
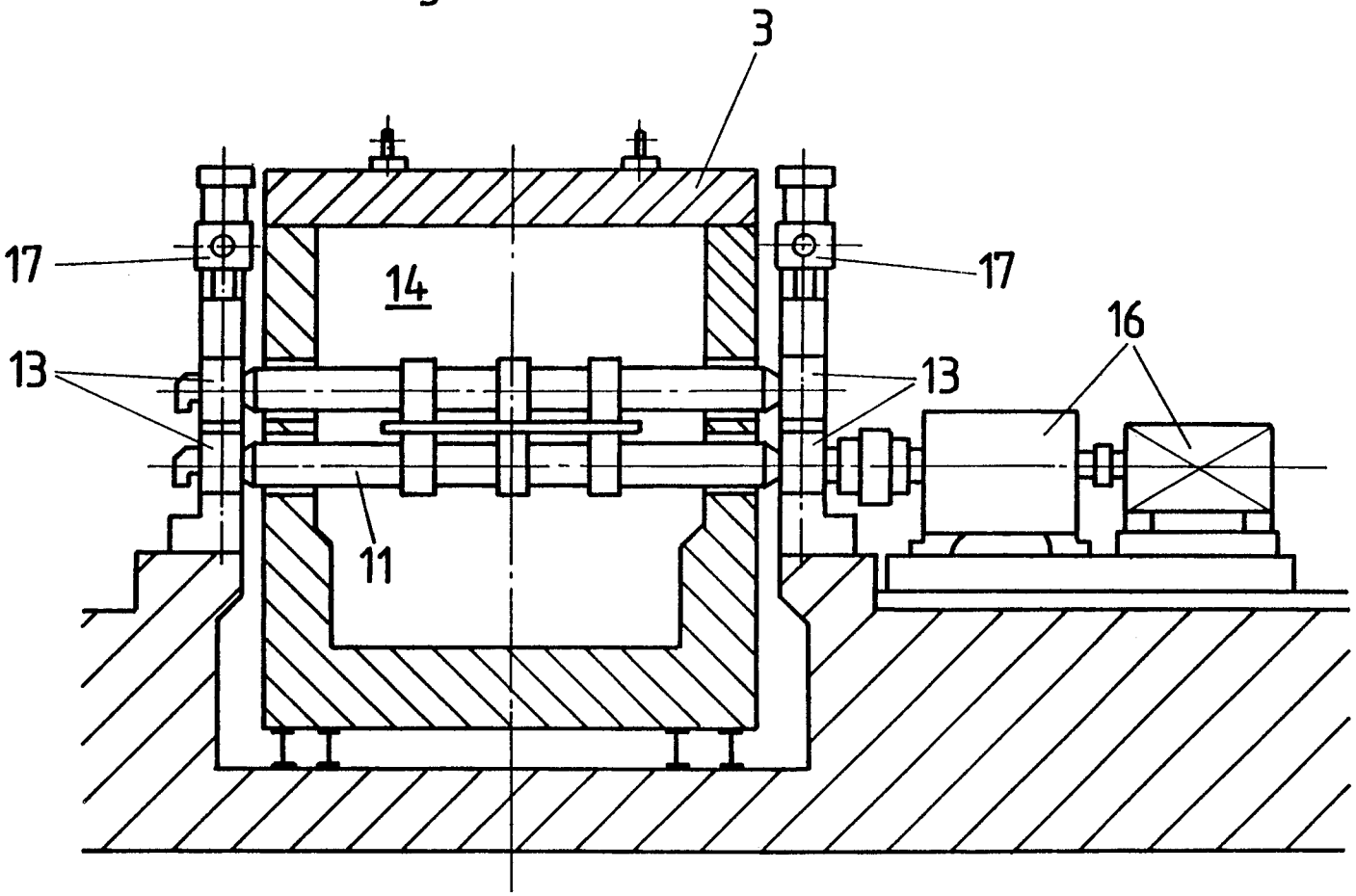
FIG. 2 is a cross-sectional view of the strip guiding means taken along the line II—II of FIG. 1.
Figure 3:
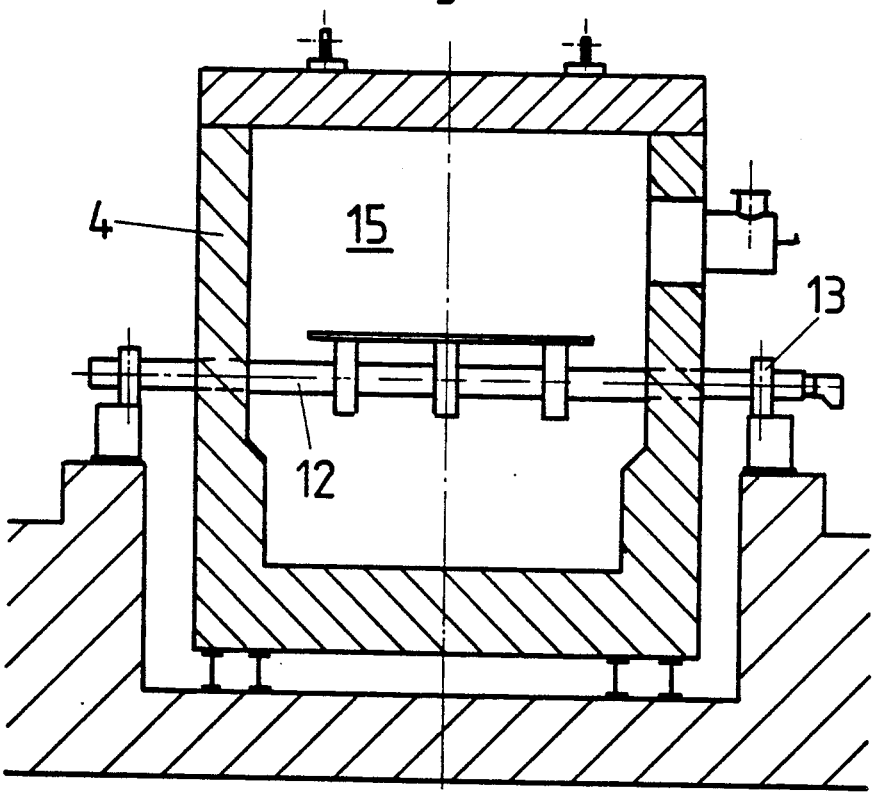
FIG. 3 is a cross-sectional view of the straight temperature equalization furnace taken along the line III—III of FIG. 1.

As best seen in FIGS. 2 and 3, the bearings of the guide rolls 10, the driving rolls 11, and the roller table rolls 12 are located outside of the furnace chambers with which they are associated to avoid heat damage. Similarly, the drives 16 and the adjusting devices 17 associated with the drive rolls 11 are located outside of the furnace chamber 14. The rolls 10, 11 and 12 may also be provided with internal cooling means (not shown) to avoid damage arising from their continuous presence within the temperature equalization environment. Further, the curved temperature equalization furnace 3, along with its associated guide rolls 10, drive rolls 11, and the associated bearings, drives, adjusting means and heat fittings, permissibly may be constructed as a modular unit. When this alternative is adopted, the removal and/or replacement of the curved temperature equalization furnace, and/or its associated components, by any suitable conveying means is facilitated.

Figure 4:
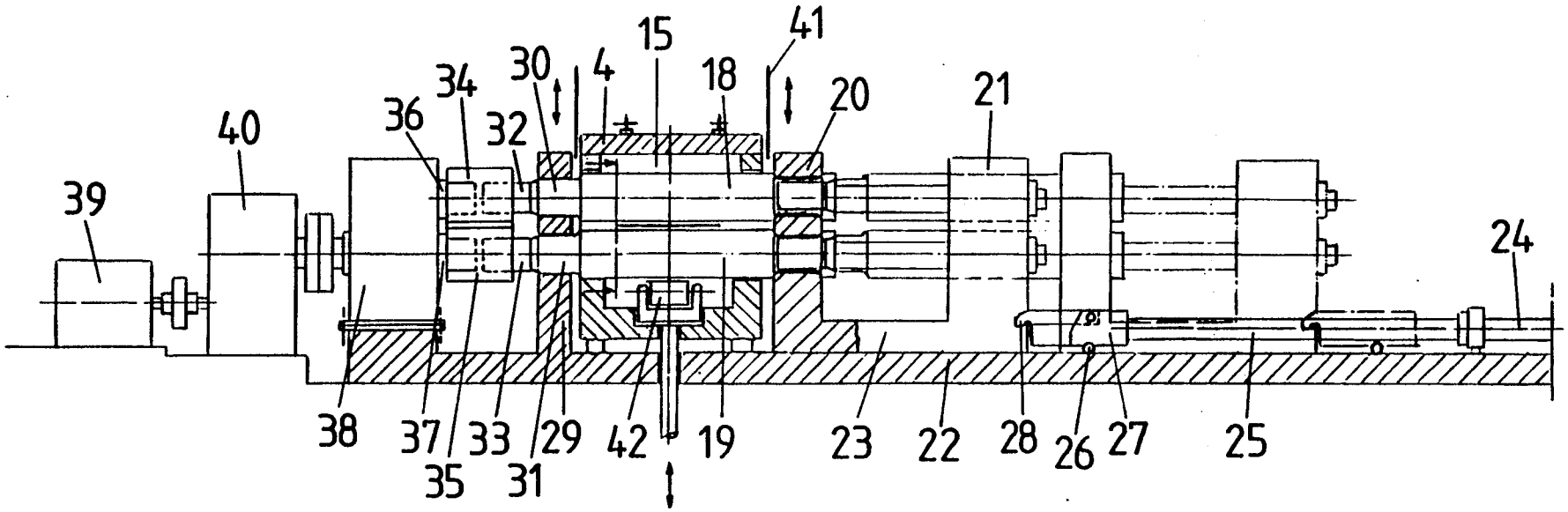
FIG. 4 is a cross-sectional view of the straight temperature equalization furnace taken along the line IV—IV of FIG. 1 showing a rotating crosscutting device.
Figure 5:
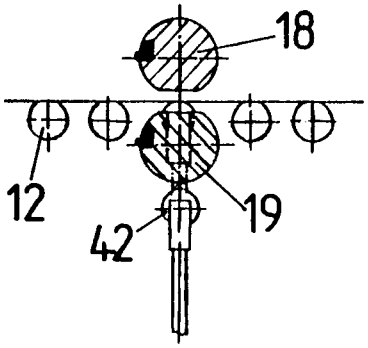
FIG. 5 is a cross sectional view of the cutting edge bearing shafts of FIG. 4.

In one embodiment of the invention, the horizontal, straight temperature equalization furnace 4 includes the rotating crosscutting means shown in FIGS. 4 and 5. The rotating crosscutting means includes a pair of vertically spaced shafts 18 and 19 mounted upon support elements 20 and 21 of support carriage 23 adjacent one lateral side of the furnace 4. The generally round shafts 18 and 19, best seen in FIG. 5, carry cutting edges on their adjacent lateral sides, and are flattened on their adjoining sides. The support carriage 23 is moveable transversely to the side of the temperature equalization furnace 4 along the path 22. Movement of the support carriage 23 is controlled by a pressure cylinder 24 operated by any suitable pressure medium, for example air or hydraulic fluid. The piston rod 25 of the cylinder 24 is connected to the support carriage 23 by the engagement of a hook portion 28 of piston head 27 therewith. The piston head 27 rides along the path 22 on a roll 26.

A bearing support 29 for the bearing journals 30 and 31 of the shafts 18 and 19 is located adjacent the opposite lateral side of the furnace 4. Coupling wobblers 32 and 33 project transversely from the bearing support 29 into coupling sleeves 34 and 35 respectively. The coupling sleeves 34 and 35 are arranged upon the take off journals 36 and 37 of a pinion gear 38 which is in turn driven by motor 39 over step up gear 40.

It will be understood that the shafts 18 and 19 are located inside the furnace chamber 15 of the furnace 4 only at the time a crosscut is to be made. To make a crosscut of the strip, opposing doors 41 in the lateral sides of the furnace 4 are opened and the table rollers 42 located between the doors are depressed from the level of their adjacent table rolls 12. The shafts 18 and 19 are then inserted through the chamber 15 by the movement of the carriage support 23 toward the furnace 4 by the cylinder 24. The free ends of the shafts engage the journals 30 and 31 and the wobblers 32 and 33. Thereafter, shaft 18 is rotated 90 degrees counterclockwise and shaft 19 is rotated 90 degrees clockwise to bring the cutting edges located on the adjacent lateral edges of the shafts together to cut the strip passing therebetween. After the execution of the crosscut, the shafts are rotated back to their original configuration, and the support carriage is moved transversely away from the furnace 4 by the cylinder 24. This laterally draws the shafts 18 and 19 out of the furnace chamber 15 through a lateral opening in the side of the furnace 4. Once the shafts are outside of the furnace chamber 15, doors 41 are slid closed to preserve the temperature equalization environment in the chamber 15, and the roller table rolls 42 previously depressed to facilitate the insertion of the shaft 19 are raised to the level of the other table rolls 12.

Figure 6:
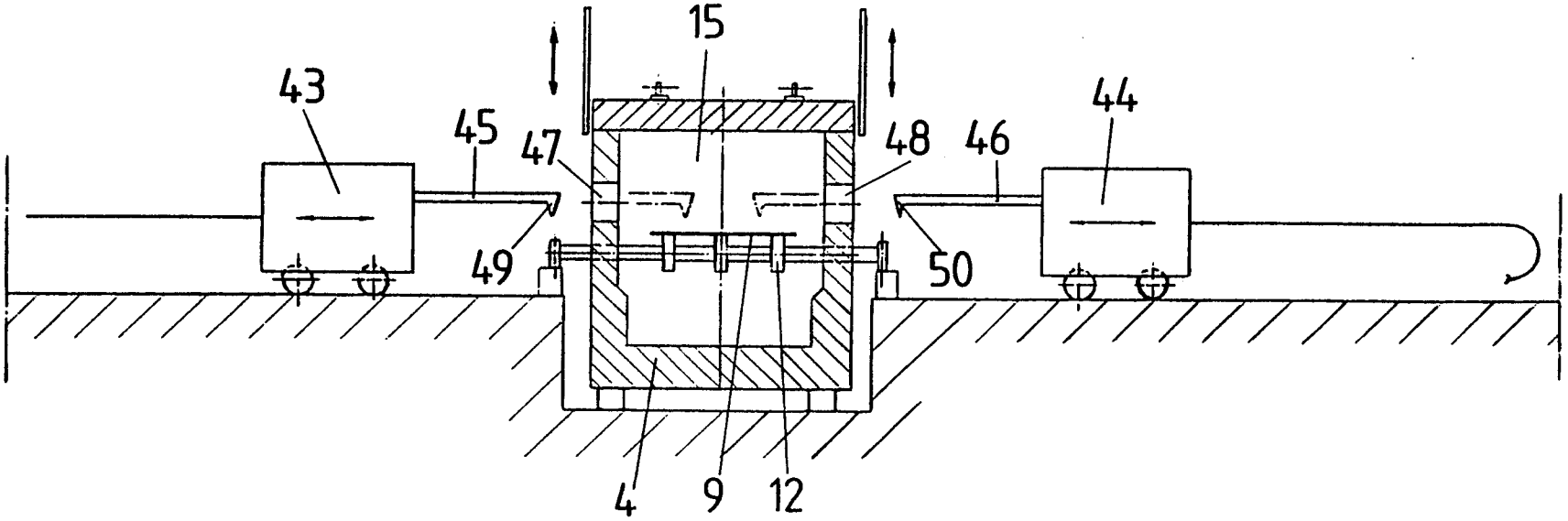
FIG. 6 is a cross sectional view of the straight temperature equalization furnace taken along the line IV—IV of FIG. 1 showing flame cutter crosscutting devices; and, FIG. 7 is a horizontal cross sectional view of the apparatus shown in FIG. 6.
Figure 7:
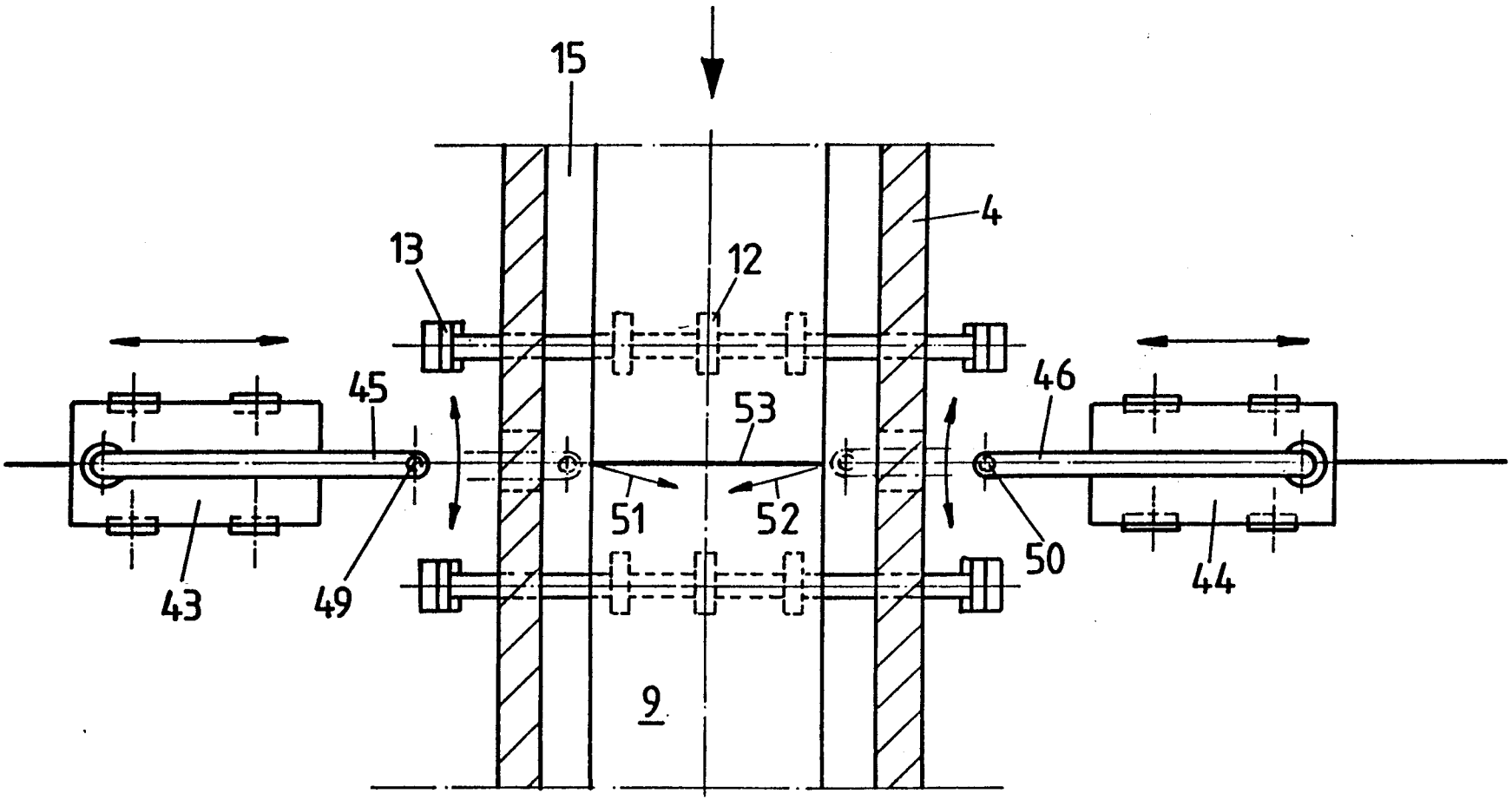

In an alternative embodiment, the crosscut of the steel strip 9 is performed by flame cutting devices 49 and 50, as best seen in FIGS. 6 and 7. In this embodiment support carriages 43 and 44, which are respectively moveable transversely to the sides of the furnace 4, are arranged adjacent the opposing lateral openings 47 and 48 in the sides of the furnace 4. Guide arms 45 and 46 are mounted to support carriages 43 and 44 respectively by swivel pivot bearings (not shown) which allow those arms to pivot about the vertical axis of the pivot in a horizontal plane. Flame cutting devices 49 and 50 are mounted to the free ends of the guide arms 45 and 46.

As in the previous embodiment, the cutting means is present within the furnace chamber 15 only during the time a crosscut is being made. To make a crosscut, the doors 41 are opened, and the flame cutting devices 49 and 50 are moved to the opposite sides of the strip passing through the furnace chamber 15 through the openings 47 and 48 by the movement of the support carriages 43 and 44 toward the furnace 4. The flame cutters 49 and 50 initiate the crosscut from opposite sides of the strip 9 and proceed inwardly toward the center of the strip. In order to assure that the resulting crosscut is straight and normal to the direction of the passage of the strip through the chamber 15, control means 100 are provided to co-ordinate the movement of the flame cutters 49 and 50 with the movement of the strip. Specifically, these control means co-ordinate the movement of the carriages 43 and 44 toward the furnace 4 and the swiveling movement of the guide arms 45 and 46 such that flame cutter 49 follows a path generally indicated at 51, and flame cutter 50 follows a path generally indicated at 52. It will be understood that since the strip 9 is moving through the chamber 15 in the direction indicated by the arrow in FIG. 7 during the crosscutting operation, the slanting of the paths 51 and 52 of the flame cutters in the direction of the movement of the strip in the manner shown will result in a crosscut which is normal to the sides of the strip 9. Accordingly, the size of the acute angle formed by the paths 51 and 52 with the line 53 connecting the lateral side openings will increase with increases in the speed of the strip, and vice versa. After the cut is completed, the flame cutters are removed from the chamber 15 by pivoting the guide arms back to their original position relative to the support carriages, and moving the support carriages transversely away from the furnace 4. The doors 41 are then closed to again maintain the temperature equalization environment of the chamber 15.

Having thus described several preferred embodiments of the present invention, it should be obvious to those skilled in the art that various modifications and alterations are possible without departure from the spirit and scope of the invention in its broader aspects. Such obvious modifications and alterations are intended to be included within the scope of the invention which is not to be limited by the above discussion of the preferred embodiments thereof. The only limitations upon the scope of the invention are defined by the appended claims or their equivalents.

We claim:

1. Apparatus for the manufacture of hot rolled steel strip comprising:

a mold for the continuous casting of steel strip including cooled walls defining a substantially vertical passage having an outlet end;

a strip guiding device located adjacent said outlet end including means for diverting steel strip issuing downwardly from said outlet end into a substantially horizontal plane;

curved temperature equalization means surrounding said strip diverting means, said curved temperature equalization means positioned adjacent to said outlet end to receive said strip as said strip exiting from said mold and extending the entire length of said strip guiding device, said curved temperature equalization means having means defining a first environment enclosing said steel strip and means external to said first environment for adding heat to said first environment so that said strip is maintained at a predetermined temperature profile starting substantially at said mold outlet end and continuing during its passage through said curved temperature equalization means;

substantially horizontal strip transfer means adapted to receive steel strip from said strip guiding device;

straight temperature equalization means surrounding at least the portion of said strip transfer means adjacent said strip guiding device, said straight temperature equalization means positioned substantially adjacent to the outlet end of said curved temperature equalization means and extending the entire length of said strip transfer means, said straight temperature equalization means having means defining a second environment enclosing said steel strip and means external to said second environment for adding heat to said second environment so that said strip is maintained at a predetermined temperature profile during its passage through said straight temperature equalization means;

crosscutting means adapted to sever said steel strip within said straight temperature equalization means; and, a rolling mill adapted to receive said steel strip from said strip transfer means.

2. The apparatus of claim 1 wherein at least one pair of pressing rollers is located between said outlet end and said strip guiding device.

3. The apparatus of claim 1 wherein said curved and said straight temperature equalization means comprise furnaces.

4. The apparatus of claim 1 wherein said strip diverting means comprises a first group of rolls adapted to bend and guide the steel strip, and a second group of rolls adapted for straightening and driving said strip.

5. The apparatus of claim 4 wherein each of said first group of rolls and each of said second group of rolls include internal cooling means.

6. The apparatus of claim 4 wherein bearing means located externally of said curved temperature equalization means are associated with the rolls of said first group, and wherein adjusting drive means, rotary drive means, and bearings located externally of said curved temperature equalization means are associated with each of the rolls of said second group.

7. The apparatus of claim 1 wherein said strip guiding device is a modular unit suitable for removal from the apparatus and replacement by a similar device.

8. The apparatus of claim 1 wherein said strip transfer means comprises a series of table rollers.

9. The apparatus of claim 8 wherein the table rollers located within said straight temperature equalization means are internally cooled.

10. The apparatus of claim 8 wherein the table rollers located within said straight temperature equalization means are mounted upon support means located outside of said straight temperature equalization means.

11. The apparatus of claim 1 wherein said crosscutting means comprises a shearing device including a pair of cutting edge bearing shafts adapted for introduction into said straight temperature equalization means respectively above and below said strip transfer means, and for the rotational engagement of said cutting edges to cut said strip.

12. The apparatus of claim 11 wherein said straight temperature equalization means defines opposing lateral openings; said shafts are mounted in vertically spaced relation on support means which is moveable transverse to one of said lateral openings, and stationary bearing support means and associated drive means are located adjacent the other lateral opening, whereby said shafts may be removeably extended across said straight temperature equalization means into engagement with said bearing support means for rotation of said cutting edges into engagement with strip traveling on said strip transfer means.

13. The apparatus of claim 1 wherein said crosscutting means comprises at least one flame cutting device.

14. The apparatus of claim 13 wherein said straight temperature equalization means defines at least one lateral opening adapted for the removeable introduction of a flame cutting device.

15. The apparatus of claim 14 wherein said flame cutting device includes cutting means located at the free end of a horizontal arm, the other end of said arm being attached to support means, said support means being moveable transversely to said lateral opening, whereby said cutting means may be removeably introduced into said straight temperature equalization means through said lateral opening.

16. The apparatus of claim 15 wherein said attachment of said arm to said support allows said arm to pivot horizontally about an axis vertical to said support, and including means for controlling the pivotal movement of said arm about said axis and the movement of said support means relative to said lateral opening in relation to each other and to the movement of strip on said strip transfer means such that said cutting means follows a path normal to the edges of said strip.

17. A method for hot rolling steel strip comprising the steps of:

A. continuously casting steel strip in a strip casting mold having a vertical passage therethrough to form a steel strip which is sufficiently thin that the strip substantially solidifies upon exiting said passage;

B. diverting the strip exiting from said passage into a horizontal plane within a curved temperature equalization means, said curved temperature equalization means being positioned adjacent to said passage to receive said strip as said strip exiting from said mold and having means defining a first environment enclosing said steel strip;

adding heat to said first environment so that said strip is maintained at a predetermined temperature profile starting at the outlet end of said mold passage and continuing during its passage through said curved temperature equalization means;

D. conveying said diverted strip through a straight temperature equalization means, said straight temperature equalization means having means defining a second environment enclosing said steel strip;

E. adding heat to said second environment so that said strip is maintained at a predetermined temperature profile during its passage through said straight temperature equalization means;

F. crosscutting said strip along a line normal to its direction of travel within said straight temperature equalization means; and G. rolling said crosscut lengths of strip in a rolling mill.

18. The method of claim 17 wherein step F comprises the steps of:

F1. providing at least one flame cutting device, and

F2. guiding said flame cutting device along a path within said straight temperature equalization means determined by a component having the same speed and direction as the movement of the strip through the straight temperature equalization means and a component transverse to the direction of travel through said straight temperature equalization means equal to the effective speed at which said flame cutter is capable of severing said strip.

19. In a continuous strip casting machine having apparatus for delivering a continuous metal strip issuing from a mold to a cutter for cutting said strip into predetermined lengths, said metal strip being sufficiently thin that it substantially solidifies upon exiting from said mold, the improvement comprising:

means for physically surrounding said apparatus to define an environment enclosing said strip, and means external to said environment for adding heat to said environment, said surrounding means being positioned to receive said strip as said strip exits from said mold so that said strip is maintained at a predetermined temperature profile during its entire passage starting adjacent to said mold and continuing to said cutter.

20. In a continuous strip casting machine, the improvement according to claim 19 wherein said heat adding means comprises a furnace.

21. In a continuous strip casting machine, the improvement according to claim 19 wherein said apparatus comprises a plurality of rollers located within said environment.

22. In a continuous strip casting machine, the improvement according to claim 21 wherein each of said plurality of rollers is supported by a bearing located outside of said environment.

23. In a continuous strip casting machine, the improvement according to claim 21 further comprising means connected to at least one of said plurality of rollers for cooling said one roller.

24. In a continuous strip casting machine, apparatus for delivering a continuous metal strip issuing from a mold in a downward vertical motion to a horizontal cutter for cutting said strip into predetermined lengths, said apparatus having a strip diverter for diverting said strip vertical motion to a horizontal strip motion and a linear strip transfer means for conveying a strip issuing horizontally from said strip diverter to said cutter, said metal strip being sufficiently thin that it substantially solidifies upon exiting from said mold, the improvement comprising:

means for surrounding said strip diverter and said strip transfer means to define an environment enclosing said strip, and means external to said environment for adding heat to said environment, said surrounding means being positioned to receive said strip as said strip exits from said mold so that said strip is maintained at a predetermined temperature profile during its entire passage starting adjacent to said mold and continuing to said cutter.

25. In a continuous strip casting machine, the improvement according to claim 24 wherein said heat adding means comprises a furnace.

26. In a continuous strip casting machine, the improvement according to claim 25 wherein said strip diverter and said strip transfer means comprise a plurality of rollers located within said environment.

27. In a continuous strip casting machine, the improvement according to claim 26 wherein each of said plurality of rollers is supported by a bearing located outside of said environment.

28. In a continuous strip casting machine, the improvement according to claim 27 further comprising means connected to at least one of said plurality of rollers for cooling said one roller.

* * * * *

UNITED STATES PATENT AND TRADEMARK OFFICE

CERTIFICATE OF CORRECTION

PATENT NO. : 5,065,811

DATED : November 19, 1991

INVENTOR(S) : Heinrich Scholz and Rudolf Guse

It is certified that error appears in the above-identified patent and that said Letters Patent is hereby corrected as shown below:

Claim 1, column 6, line 67, please delete "outlet", insert --outer--.

Claim 17(B), column 8, line 33, please delete "as said strip", and
column 8, line 38, please delete "outlet", insert --outer--.

Signed and Sealed this

First Day of June, 1993

*Attest:*

*Attesting Officer*

Michael K. Kirk

MICHAEL K. KIRK

*Acting Commissioner of Patents and Trademarks*